United States Patent [19]

Venetta

[11] 4,285,670

[45] Aug. 25, 1981

[54] SHAKER CONVEYOR CONSTRUCTION

[76] Inventor: Henry J. Venetta, 9613 Holland Springs Rd., Warren, Ohio 44484

[21] Appl. No.: 100,966

[22] Filed: Dec. 6, 1979

[51] Int. Cl.[3] ..... F27D 23/00

[52] U.S. Cl. ..... 432/88; 414/156; 432/134

[58] Field of Search ..... 432/88, 134; 414/156, 414/179; 266/267, 178

[56] References Cited

U.S. PATENT DOCUMENTS

| | | | |
|---|---|---|---|
| 2,521,591 | 9/1950 | Martin | 432/134 |
| 3,667,747 | 6/1972 | Graybill et al. | 432/134 |
| 3,721,519 | 3/1973 | Venetta | 432/88 |
| 3,813,209 | 5/1974 | Venetta | 432/11 |

*Primary Examiner*—John J. Camby

*Attorney, Agent, or Firm*—Oldham, Oldham, Hudak & Weber Co.

[57] ABSTRACT

A metal heating apparatus including a plurality of flattened U-shaped in section metal desk plates positioned in longitudinally overlapped relation to form a metal conveyor and an article receiving unit, a plurality of metal support plates or saddles below the deck plates and having complementary recessed upper surfaces contoured to receive and receiving the deck plates therein; bolt anchor means are positioned on the lower surfaces of the deck plates, and offset support means are secured to the saddle plates whereby bolt means can be attached to the support means and extend to and be secured to the bolt anchor means for anchoring the deck plates to the support means, but to permit some relative movement therebetween upon changes in heating and cooling conditions.

7 Claims, 3 Drawing Figures

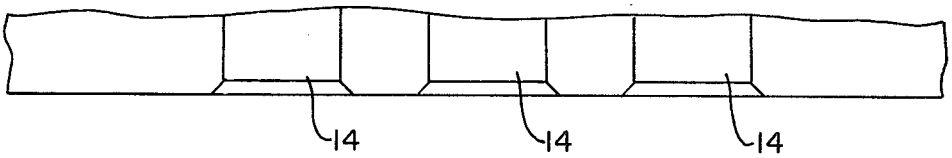
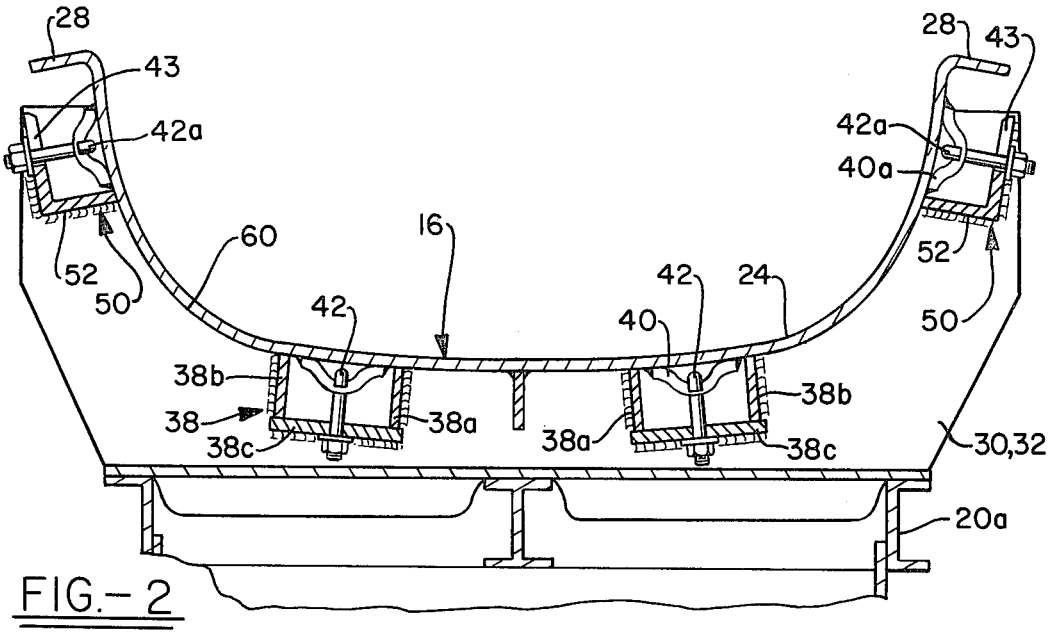
FIG.-2
FIG.-3
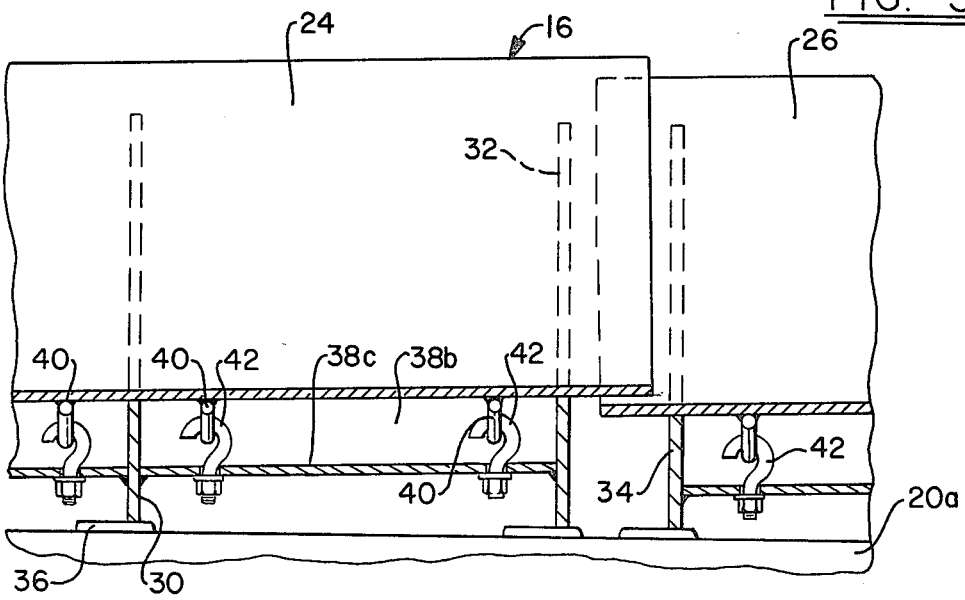

SHAKER CONVEYOR CONSTRUCTION

BACKGROUND OF THE INVENTION

At the present time, there is an appreciable amount of work being done on the preheating of various metals and, particularly, scrap metal before it is charged into a melt furnace for further heating and processing. One commercially available system that has been provided heretofore includes the type of metal scrap preheat means and apparatus such as are shown in my prior U.S. Pat. Nos. 3,813,209 and 3,721,519. In this apparatus, a metal receiving conveyor is provided by a plurality of metal deck plates that are substantially U-shaped in section and which are positioned in longitudinally overlapping relationship to each other to provide a trough for receipt and transmittal of metal as it is being passed into and through a preheat furnace. These deck plates and support means are positioned upon a suitable jog-type conveyor, as disclosed in my prior Pat. No. 3,721,519.

It always is a problem to maintain these deck plates of the conveyor in good operative positions on anchor or support means because the conveyor and associated apparatus go through repeated heating and cooling cycles dependent upon the metal received therein, its temperature, whether the preheat furnace is being operated continuously, etc. Furthermore, the jogging drive action on the assembled conveyor to advance metals into and through the furnace is a primary factor that makes it difficult to maintain the conveyor deck plates in good operative association with the remainder of the apparatus.

Accordingly, it is the general object of the present invention to provide a novel and improved metal receiving conveyor formed from a plurality of metal deck plates positioned in longitudinally overlapped relation for forming a metal receiving and transmitting unit, and wherein the deck plates are effectively and operatively secured in position for a good service life.

Another object of the invention is to secure metal deck plates in a metal support conveyor by anchor members whereby some limited movement can occur between the metal deck plates and the support means or anchors with changes in temperatures and operating conditions.

Another object of the invention is to form metal deck plates in a metal receiving and transmitting unit, such as a conveyor, wherein the deck plates are of arcuate contours and of generally elipse shape.

Yet another object of the invention is to provide a sturdy and improved metal receiving and transmitting unit for use in metal transmitting and preheating apparatus, such as scrap metal preheat furnaces.

Yet another object of the invention is to secure metal deck plates to reinforcing anchor means at spaced localized areas only, and to permit limited relative movement of the deck plates in relation to the securing bolts and anchor means attaching them in position.

The foregoing and other objects and advantages of the invention will be made more apparent as the specification proceeds.

When referring to corresponding members shown in the drawings and referred to in the specification, corresponding numerals are used to facilitate comparison therebetween.

With reference to the accompanying drawings,

FIG. 2 is a fragmentary enlarged vertical section of the metal transfer conveyor means of the apparatus; and FIG. 3 is a fragmentary side elevation of a portion of the metal scrap transfer conveyor of the invention.

SUBJECT MATTER OF THE INVENTION

Figure 1:
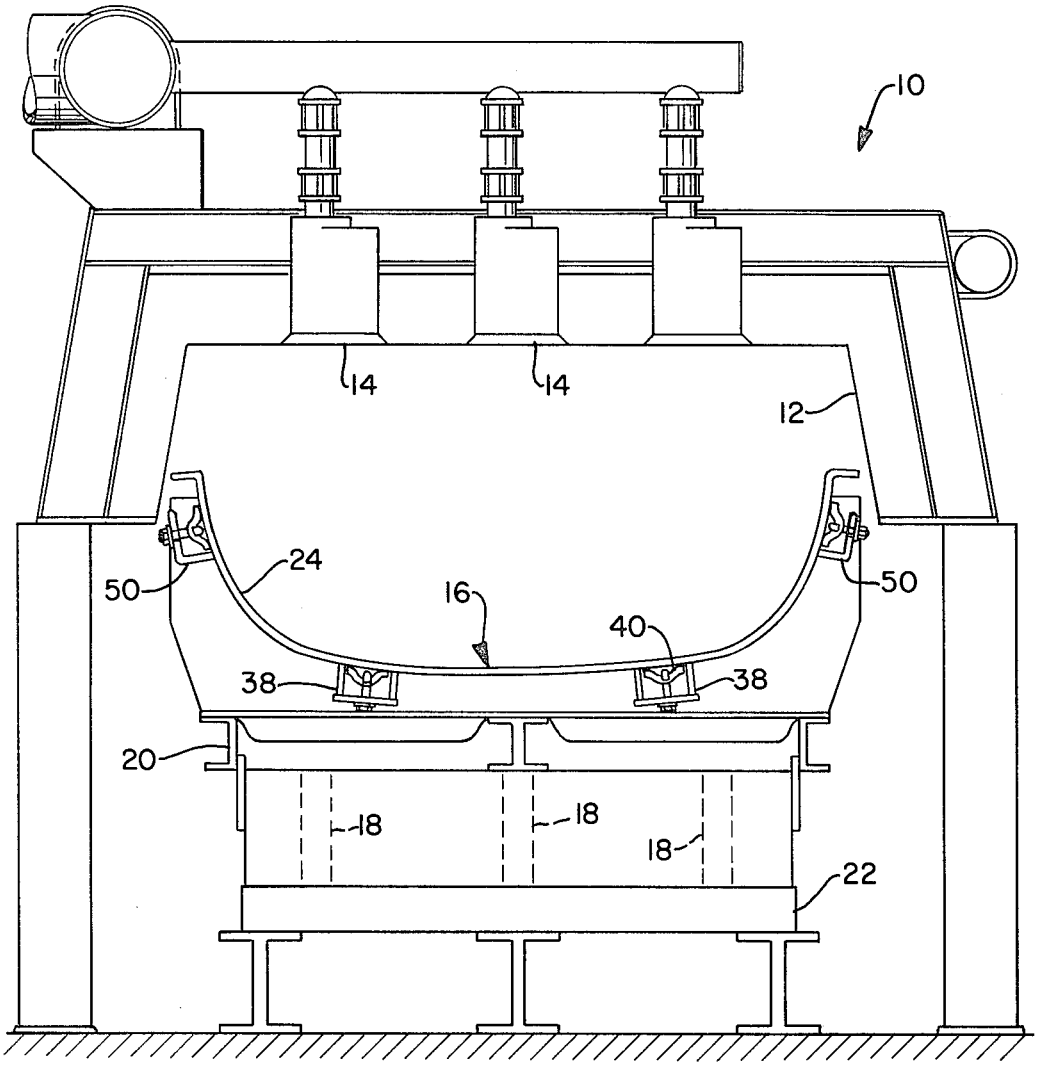
FIG. 1 is a vertical cross section through a metal scrap preheat furnace with the apparatus of the invention associated therewith.

The present invention relates to a metal preheating apparatus, and it involves a metal transfer conveyor, normally associated with a metal preheat furnace and involving a plurality of substantially flattened U-shaped in section metal deck plates that are positioned in longitudinally overlapped relation and form the conveyor, a plurality of metal plate saddles below the deck plates and having recessed upper surfaces contoured to receive the deck plates therein, which saddles extend transversely of the deck plates, bolt anchor means that are secured to spaced portions of the lower surfaces of the deck plates, support means secured to and extending between adjacent pairs of the saddles that are attached to a common deck plate, and bolt means are secured to the support means and engage the bolt anchor means for attaching the deck plates to the metal saddles but permitting limited relative movement therebetween.

Reference now is made to the details of the structure shown in the accompanying drawings, and a metal preheat furnace is indicated as a whole by the numeral 10. This furnace is of the type shown in my prior U.S. Pat. No. 3,721,519 and it includes a suitable oven or furnace chamber 12 which chamber 12 mounts a plurality of suitable burners 14 at an upper roof area thereof. Conventional means supply these burners 14 with known types of combustible materials whereby burning gases and flames are impinged downwardly of the oven for heating any metal or materials received in the furnace chamber 12.

Extending longitudinally of the chamber is a metal transfer and carrier conveyor means 16. This conveyor means 16 is mounted on a plurality of conventional coil springs or the like indicated diagrammatically at 18 in FIG. 1 whereby known types of drive members (not shown) can connect to base beams 20 or the like for the conveyor means 16 and provide an intermittent jog-type drive thereto. The conveyor also has base support members 22 on which the lower ends of the springs 18 are attached for resiliently mounting the conveyor to facilitate jogging or bumping the material, such as scrap metal, in the conveyor to move it longitudinally of the furnace in a known manner.

This conveyor means 16 comprises a plurality of longitudinally overlapped deck plates 24,26 as indicated in FIG. 3 and any suitable number of these plates may be provided and they are of generally a flattened U-shape in section as shown in FIGS. 1 and 3. These deck plates may also be said to be of elliptical shape in cross section, and they generally are just smoothly curved from an edge flange 28 thereof to the opposite edge flange 28 for forming a receptacle for material to be heated and processed.

In order to position the deck plates in the apparatus, a plurality of transversely extending saddles 30, 32, 34 are provided and normally each deck plate 24 or 26 is supported on at least two of these saddles that are in the form of metal plates and which have lower or base surfaces that are suitably secured to cross plates or bars 36 that in turn are secured to the longitudinally extending support base 20*a* in the unit.

The apparatus is so designed that preferably these tranversely extending saddle plates are about 12 inches apart longitudinally of the apparatus when engaging the same deck plate but if the saddle plates engage different deck plates, then they may be more closely positioned in relation to each other, if desired.

The drawings also show that a plurality of pairs of substantially U-shaped support members or brace units 38 are positioned to and extend between the adjacent pairs of saddle plates 30,32 that are engaged with a common deck plate, each brace unit comprising a pair of support bars 38*a* and 38*b* and a top cover bar 38*c*. Such bars 38*a* and 38*b* are welded at their ends to the saddle plates 30 and 32. The attachment of the individual saddle plates and brace units to the deck plates is provided by means of anchor engaging members such as flattened U-shaped braces or anchors 40 which are secured at their ends, as by welding, to an individual deck plate and extend transversely thereof. Thus, the center portions of these anchors 40 are spaced from the adjacent bottom of the deck plate, and suitable bolt members 42, which may be either J-bolts or U-bolts, have one attaching end thereof threaded through into engagement with the individual anchors 40 and then the opposite ends of the bolt extend through the cover plates 38*c* of the brace unit and are suitably tightly attached thereto. Hence, a bolt connection is provided between the individual deck plates and the saddle plates to which the deck plates are secured. However, limited adjusting movement is permitted between these members with changes in temperature as will occur when the furnace is operated intermittently or when the furnace is heated up and then cooled down during any type of heating or metal processing action that may be set up in the preheat furnace 10.

Adjacent the upper margins of these deck plates is a slightly modified type of a brace unit 50 wherein just a right angle member 52 is secured at its ends to a pair of the adjacent saddle plates. A suitable J-bolt 42*a* is received in a slot 43 in this angle member 52 and it engages an anchor device 40*a* provided on the outer surface of the deck plate adjacent its upper edge flange. The bolt 42*a* is fixedly secured in position after being threaded into engagement with the anchor 40*a*. Such positioning provides slight movement and adjustment between the deck plate and its support.

In the apparatus of the invention, all of the bolt anchor means 40, 40*a*, etc. engaging a sectional area of any one of the deck plates, as indicated in FIG. 2, are all positioned in alignment transversely of the deck plate. Furthermore, it should be noted that the upper surfaces of these saddles 30, 32, 34, etc. are contoured as at 60 complementary to the lower surfaces of the individual deck plates. Hence, a good mechanical engagement can be obtained between the deck plate and its support saddle.

Usually, these saddles 30, 32 when engaging a common deck plate are positioned about 12 inches apart from each other longitudinally of the apparatus and in the flow direction of metal on the transfer conveyor. Also, the rows or the anchor means, as shown in FIG. 2, and which are spaced transversely of the apparatus, usually are positioned about 12 inches apart transversely of the deck plates so that just localized areas of the deck plates are fixedly secured to their associated support means. Hence, the spaced bolt connections extending between the saddles and the deck plates will permit limited expansion and contraction of the various components of the apparatus with relation to each other as the temperatures of the apparatus varies upon heating and cooling conditions.

It will be noted that there is no welding or fixed connection between the deck plates and the saddle plates that form the primary support therefor. The arcuate shape of the conveyor deck plates provides effective means for maintaining scrap metal positioned on the conveyor in good heat transfer relationship to the conveyor and to heating action supplied by the gases in the furnace. The shape of the deck plates also could be said to be concave on both its upper and lower surfaces as these plates are just in general of flattened U-shape or of varying curved shape from side to side thereof whereby expansion and contraction of these plates will occur readily in the apparatus and the anchor means provided therefor will facilitate relative adjustment in position of the deck plate and its attachment means depending upon changing parts and size relationship in the apparatus.

It will be appreciated that the apparatus of the invention should be made from relatively sturdy metal plates, beams and the like, and naturally quite sturdy bolt means and brace units are provided in the apparatus. Hence, a very effective mechanical bonding action or positioning action for the deck plates is provided to give the apparatus a long service life. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. In a metal heating apparatus, a plurality of metal deck plates positioned in longitudinally overlapped, aligned relation to form a metal receiving and transmitting conveyor, said deck plates being of substantially flattened U-shape in transverse vertical section, a plurality of metal plate saddles below said deck plates and having recessed upper surfaces contoured to receive said deck plates therein, said saddles extending transversely of said deck plates and supporting the same, bolt anchor means secured to spaced portions of the lower surfaces of said deck plates, support means secured to and extending between said saddles, and bolt means secured to said support means and engaging said bolt anchor means to secure said deck plates to said saddles.

2. In metal heating apparatus as in claim 1 where said support means are spaced from each other to define rows extending longitudinally of said deck plates, and the bottom and lower side areas of said deck plates are concave.

3. In metal heating apparatus as in claim 1 where said deck plates are of elliptical shape in cross section, said deck plates are secured to said saddles only at spaced local areas, and relative movement of said deck plates and saddles can occur.

4. In a metal heating apparatus, a resiliently mounted assembly including a plurality of metal deck plates positioned in aligned, longitudinally overlapped relation to form an open topped metal receiving and transmitting unit, said deck plates being arcuate in vertical cross section, a plurality of metal plate saddles below said deck plates and having recessed upper surfaces contoured complementary to said deck plates and receiving said deck plates in said recesses, said saddles extending transversely of said deck plates and supporting the same, bolt anchor means secured to spaced parts of the lower surfaces of said deck plates and being aligned transversely of said deck plates, support means secured to and extending between adjacent pairs of said saddles, said support means overlying said bolt anchor means, and bolt means extending between said support means and said bolt anchor means to secure said deck plates to said saddles.

5. In metal heating apparatus as in claim 4 where a plurality of said saddles engage each of said deck plates and are spaced about 12 inches apart longitudinally of any said deck plate, and said support means are spaced about 12 inches apart transversely of said saddles, and the bottom and lower side areas of said deck plates are concave.

6. In metal heating apparatus as in claim 4 where said deck plates are of elliptical shape in cross section, said deck plates are secured to said saddles only at spaced local areas, relative movement of said deck plates and saddles is permitted on heating and cooling the apparatus, and each said deck plate is engaged by at least two of said saddles.

7. In a metal heating apparatus as in claim 4, a plurality of longitudinally extending support beams for said saddles, and spring means engaging and positioning said support beams.

* * * * *